US008955834B1

(12) United States Patent
Imaizumi

(10) Patent No.: US 8,955,834 B1
(45) Date of Patent: Feb. 17, 2015

(54) IMAGE FORMING APPARATUS AND METHOD FOR PREVENTING SETTING ERROR ON SHEET SIZE

(71) Applicants: Kabushiki Kaisha Toshiba, Minato-ku, Tokyo (JP); Toshiba Tec Kabushiki Kaisha, Shinagawa-ku, Tokyo (JP)

(72) Inventor: Ryuta Imaizumi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/018,659

(22) Filed: Sep. 5, 2013

(51) Int. Cl.
*B65H 5/00* (2006.01)
*B65H 7/02* (2006.01)
*B65H 1/04* (2006.01)

(52) U.S. Cl.
CPC ..... *B65H 1/04* (2013.01)
USPC ..... 271/10.02; 271/10.03; 271/258.01; 271/265.01

(58) Field of Classification Search
USPC ..... 271/10.02, 10.03, 258.01, 265.01
See application file for complete search history.

(56) References Cited

U.S. PATENT DOCUMENTS

| | | | | |
|---|---|---|---|---|
| 5,676,363 | A * | 10/1997 | Kishida et al. | 271/10.01 |
| 5,722,029 | A * | 2/1998 | Tomidokoro et al. | 399/389 |
| 5,826,156 | A * | 10/1998 | Natsume et al. | 399/389 |
| 7,651,092 | B2 * | 1/2010 | Hirao et al. | 271/298 |
| 7,957,687 | B2 * | 6/2011 | Ito | 399/389 |
| 2008/0084020 | A1 * | 4/2008 | Nakamura | 270/1.01 |

FOREIGN PATENT DOCUMENTS

JP 2010-222097 10/2010

* cited by examiner

*Primary Examiner* — David H Bollinger
(74) *Attorney, Agent, or Firm* — Amin, Turocy & Watson, LLP

(57) ABSTRACT

Generally, in accordance with one embodiment, an image forming apparatus includes a stacking section, a sensor, a printing unit, a display and a controller. The stacking section is configured to stack a sheet. The sensor is configured to detect the size of the sheet set on the stacking section. The printing unit is configured to form an image on the sheet. The display is configured to display the image. The controller is configured not to display a sheet size except the sheet size detected based on an output signal from the sensor on a setting screen for the sheet size of an image forming object in a detectable status.

9 Claims, 5 Drawing Sheets

IMAGE FORMING APPARATUS AND METHOD FOR PREVENTING SETTING ERROR ON SHEET SIZE

FIELD

Embodiments described herein relate to a technology for preventing a setting error on a sheet size.

BACKGROUND

Conventionally, in an image forming apparatus, a sheet size in an option setting for a print job, irrespective of a sheet size detected by a sensor, can be freely set by a user. Therefore, in the case that the sheet size which is detected by the sensor differs from a sheet size which is set by the user, and when the job is executed, the image forming apparatus in which an error occurs displays a warning for urging a user to confirm the sheet size. At this moment, the user needs to confirm a sheet which is arranged in a paper feed cassette or the set sheet size.

DETAILED DESCRIPTION

Generally, in accordance with an embodiment, an image forming apparatus comprises a stacking section, a sensor, a printing unit, a display and a controller. The stacking section is configured to stack a sheet. The sensor is configured to detect the size of the sheet which is set on the stacking section. The printing unit is configured to form an image on the sheet. The display is configured to display the image. The controller is configured to not to display a sheet size except the detecting sheet size based on the output signal of the sensor in a selectable status on the setting screen for a sheet size of an image forming object.

Generally, in accordance with the embodiment, a method for preventing a setting error on the sheet size is according to the image forming apparatus comprising the stacking section configured to stack the sheet; the sensor configured to detect the size of the sheet set on the stacking section; the printing unit configured to form the image on the sheet; and the display configured to display the image, which including: detecting the size of a sheet on the stacking section based on the output signal of the sensor, no displaying a sheet size except the detecting sheet size in a selectable status on the setting screen for a sheet size of an image forming object.

Hereinafter, the embodiment will be described with reference to accompanying drawings.

Figure 1:
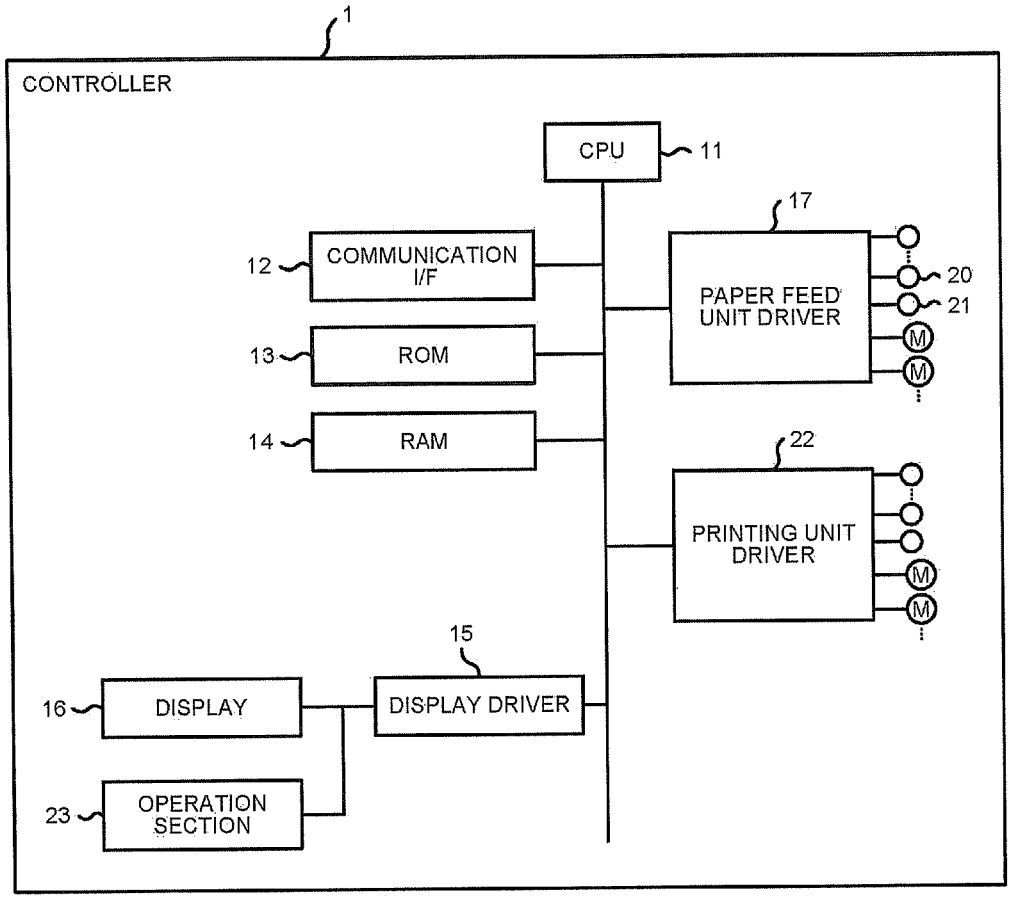
FIG. 1 is a diagram illustrating a structure of an image forming apparatus.

FIG. 1 is a diagram illustrating a structure of an image forming apparatus 1.

The image forming apparatus 1 is a MFP (Multi Function Peripheral) having a function of such as scanning, printing, FAX and the like. The image forming apparatus 1 comprises a CPU (Central Processing Unit) 11, a communication I/F (Interface) 12, a ROM (Read Only Memory) 13, a RAM (Random Access Memory) 14, a displaying operation driver 15, a display 16, a paper feed unit driver 17, a manual feeding tray (stacking section) not shown in figures, a paper feed cassette (stacking section) not shown in figures, sheet sensors 20 and 21, a printing unit driver 22 and an operation panel 23.

The CPU 11 realizes various functions by executing programs stored in the ROM 13. The CPU 11, the ROM 13 and the RAM 14 constitutes a controller for controlling the whole image forming apparatus 1.

The communication I/F 12 is an interface which is used for the CPU 11 to communicate with an external device on a network in a wireless or wired manner.

The ROM 13 stores various control programs.

The RAM 14 provides a temporary work area for the CPU 11.

The displaying operation driver 15 is an interface which is used for the CPU 11 to control the display 16.

The display 16 displays the setting information, the operation status and the log information of the image forming apparatus 1, and a notice to a user. In addition, the display 16 which will be described later displays the setting screen for the sheet size of the image forming object.

The paper feed unit driver 17 is an interface which is used for the CPU 11 to control a paper feed unit. The paper feed unit is a unit configured to feed paper to the printing unit which forms the image on the sheet. The paper feed unit driver 17 is connected with various sensors for the paper feed unit including the sheet sensors 20 and 21, a motor and the CPU 11.

The manual feeding tray can be accessed directly from the external of the image forming apparatus 1. The manual feeding tray stacks a specified sized sheet and a non-specified sized sheet (sheet from the paper feed cassette, which cannot be printed) which cannot be set in the paper feed cassette. The so-called non-specified sized sheet refers to as a long sheet, a thick sheet, a label sheet, an OHP film (Over Head Projector Film), a postcard, an envelope and the like. In the manual feeding tray, the specified sized sheet is set to be horizontal relative to a paper feed direction such that a longitudinal direction is perpendicular to the paper feed direction of the sheet from the manual feeding tray. In addition, as the long sheets in a LD size (279×432 mmmm) and an A3 size (297 mm×420) cannot be set to be horizontal, they are set to be vertical (the longitudinal direction is parallel to the paper feed direction) on the manual feeding tray.

The sheet sensor 20 detects a length in a direction which is orthogonal to the paper feed direction for the sheet on the manual feeding tray, namely, detects the length (hereinafter, called as longitudinal width of a sheet) in the longitudinal direction of the sheet.

The paper feed cassette stacks the specified sized sheet. The paper feed cassette can be housed inside the image forming apparatus 1, and can be pulled out from the image forming apparatus 1. In the paper feed cassette, the sheet is set to be vertical relative to the paper feed direction such that the longitudinal direction is along the paper feed direction of the sheet from the paper feed cassette.

The sheet sensor 21 detects the length in the direction which is orthogonal to the paper feed direction for the sheet on the paper feed cassette, namely, detects the length (hereinafter, called as width of a sheet) in the lateral direction of the sheet.

The printing unit driver 22 is an interface which is used for the CPU 11 to control the printing unit. The printing unit driver 22 is connected with various sensors of the printing unit, the motor and the CPU 11.

The operation panel 23 which comprises operation keys or a touch panel accepts the input and the like of a starting instruction for an image forming processing or a setting option for the image forming processing from a user.

Figure 2:
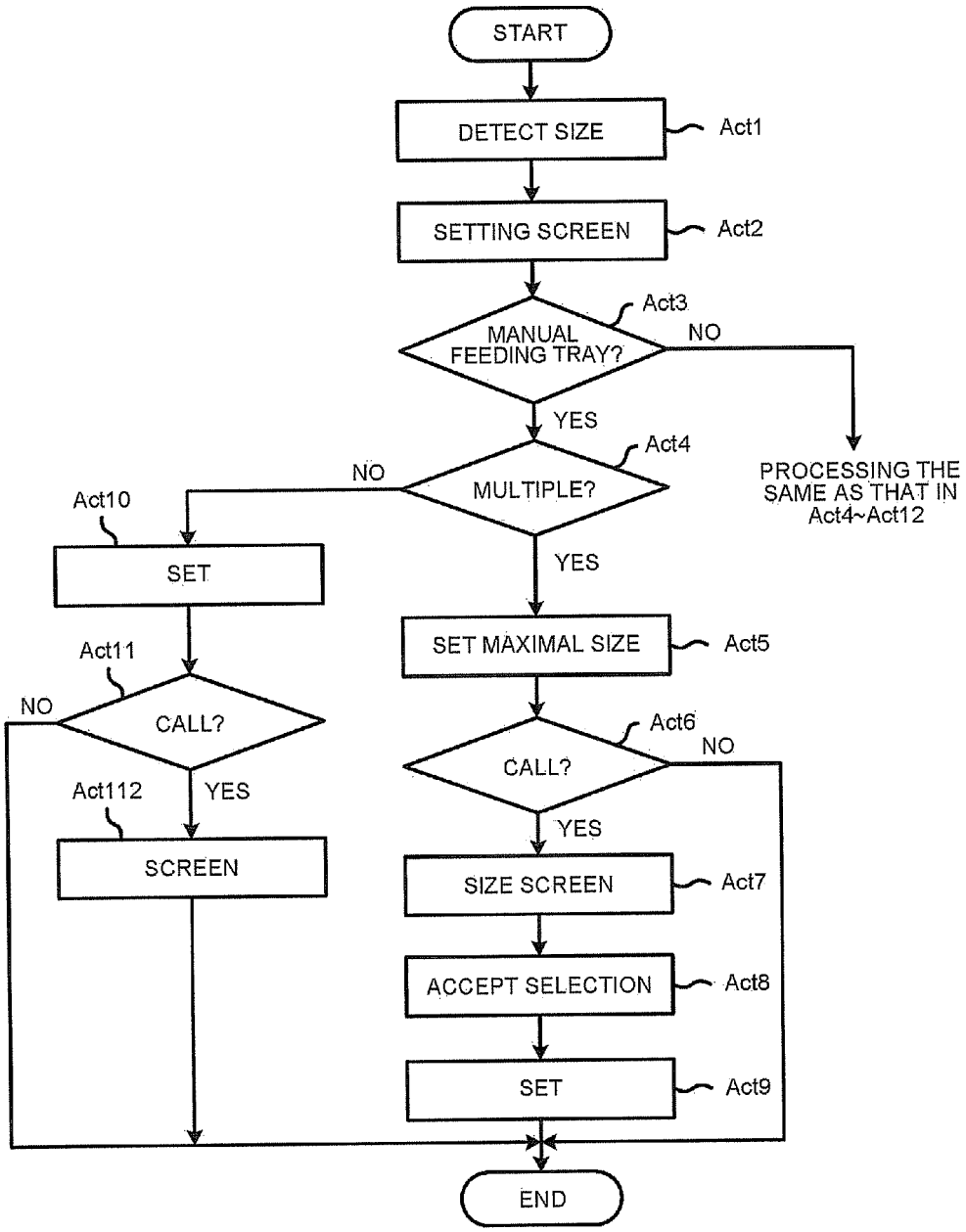
FIG. 2 is a flowchart for describing a processing of preventing a setting error on a sheet size.

Hereinafter, a processing of preventing the setting error of the sheet size according to the CPU 11 will be described with reference to the flowchart in FIG. 2. The processing is realized through the CPU 11 reading programs for preventing the setting error in the ROM 13.

The CPU 11 detects the sizes of the sheets on the manual feeding tray and the paper feed cassette based on output signals from the sheet sensors 20 and 21 (Act1). Specifically, in the ROM 13, the value of the output signal from the sheet sensor exists, namely, a manual-oriented table in which the longitudinal width of a sheet detected by the sheet sensor 20 is mapped with the sheet size exists. In addition, in the ROM 13, a cassette-oriented table in which the width of a sheet detected by the sheet sensor 21 is mapped with the sheet size exists.

In the manual-oriented table, for example, a longitudinal width of a sheet 140 mm is mapped with ST-R (216 mm×140 mm) as the sheet size. A sheet in a ST size (140 mm×216 mm) is set in a horizontal status that the longitudinal direction (the side of 216 mm) is enabled to be perpendicular to the paper feed direction on the manual feeding tray if being in a normal posture. A ST-R size refers to the sheet size when the sheet is set in a horizontal status (a status in which a lateral side (140 mm side) is detected by the sheet sensor 20) that the longitudinal direction (the side of 216 mm) is parallel to the paper feed direction.

In addition, in the manual-oriented table, a longitudinal width of a sheet 216 mm is mapped with LT-R (279 mm×216 mm) as the sheet size.

In the manual-oriented table, two sheet sizes are sometimes mapped with one longitudinal width of a sheet. For example, a longitudinal width of a sheet 279 mm is mapped with LT (216 mm×279 mm) and LD (432 mm×279 mm) as the sheet size. In addition, a longitudinal width of a sheet 297 mm is mapped with A4 (210 mm×297 mm) and A3 (420 mm×297 mm) as the sheet size.

Even in the cassette-oriented table, the same as the manual-oriented table, the sheet size is also mapped with the width of a sheet.

The CPU 11 detects the size of the sheet on the manual feeding tray when the sheet is arranged on the manual feeding tray. The CPU 11 detects the size of the sheet on the paper feed cassette when the paper feed cassette is housed inside the image forming apparatus 1.

The CPU 11 accepts the call of a print setting screen from a user on the operation panel 23 (Act2).

The CPU 11 determines whether or not a paper feed destination is set to be the manual feeding tray (Act3). When the paper feed destination is set to be the manual feeding tray (YES in Act3), the CPU 11 determines whether or not the longitudinal widths of a sheet detected by the sheet sensor 20 are multiple (Act4). The CPU 11, for example, determines the sheet sizes to be multiple when the sheet sensor 20 detects the longitudinal width of a sheet to be 279 mm and the sheet sizes to be the LT size and the LD size (YES in Act4). The CPU 11 sets the sheet size to be a maximal size (Act5) when determining the sheet sizes to be multiple (YES in Act4). For example, when the sheet sensor 20 detects the longitudinal width of a sheet to be 279 mm and detects the sheet sizes to be the LT size and the LD size, in this case, The CPU 11 sets the sheet size to be the LD size which is larger than the LT size.

Figure 3:
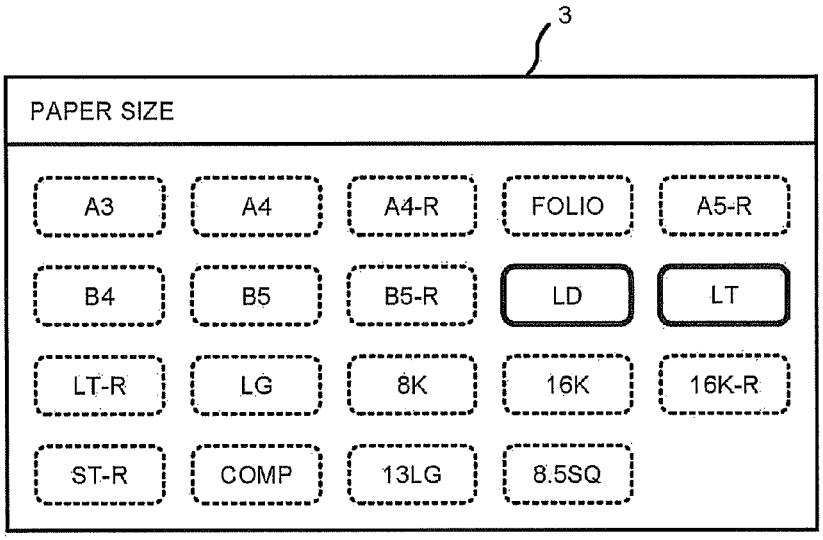
FIG. 3 is a diagram illustrating a setting screen for the sheet size when a plurality of sheet sizes are detected.

FIG. 3 is a diagram illustrating the setting screen for the sheet size of the image forming object.

The CPU 11 determines whether or not to accept the call of a setting screen 3 for the sheet size of the image forming object (Act6). The CPU 11 displays the setting screen 3 on the display 16 (Act7) when accepts the call of the setting screen 3 (YES in Act6).

The CPU 11 displays detected multiple sheet sizes on the setting screen 3 in a selectable status. In the present embodiment, the multiple detected sheet sizes are displayed through buttons (the LD button and the LT button in FIG. 3). The CPU 11 displays buttons (the LT-R button, the LG button . . . in FIG. 3) for other detectable sheet sizes together with the buttons (the LD button and the LT button in FIG. 3) for the multiple detected sheet sizes on the setting screen 3 in a non-selectable gray out status.

Figure 4:
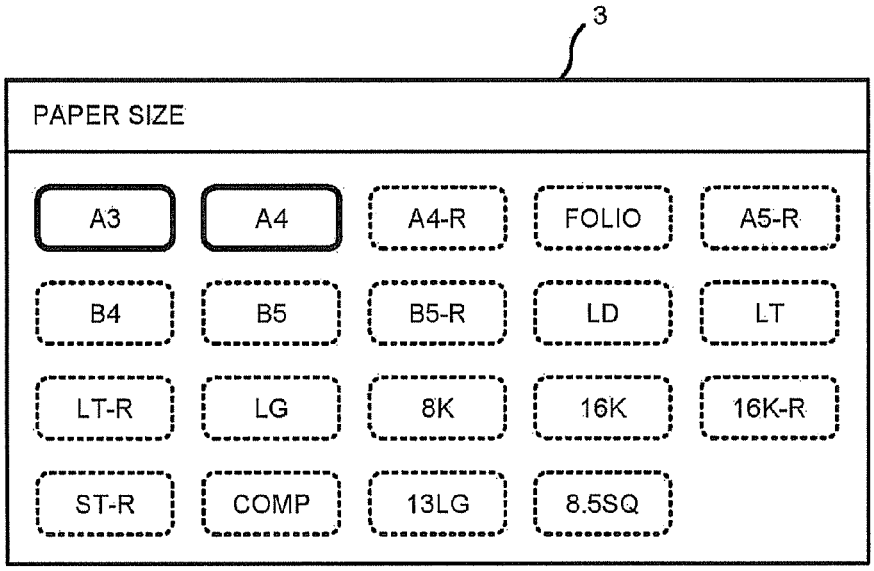
FIG. 4 is a diagram illustrating another example of the setting screen for the sheet size.

In addition, for example, when the sheet sizes are detected to be the A4 size and the A3 size according to the longitudinal width of a sheet which is detected by the sheet sensor 20 is 297 mm, the CPU 11 displays the setting screen 3 shown in FIG. 4.

The CPU 11 accepts the selection on the sheet size on the setting screen 3 (Act8). Next, the CPU 11 sets the sheet size of the image forming object to be the selected sheet size (Act9).

The CPU 11 sets the sheet size of the image forming object to be the detected sheet size (Act10) when, for example, only one of the sheet size is detected such as a ST-R (216 mm×140 mm) according to the longitudinal width of a sheet which is detected by the sheet sensor 20 is 140 mm (NO in Act4).

Figure 5:
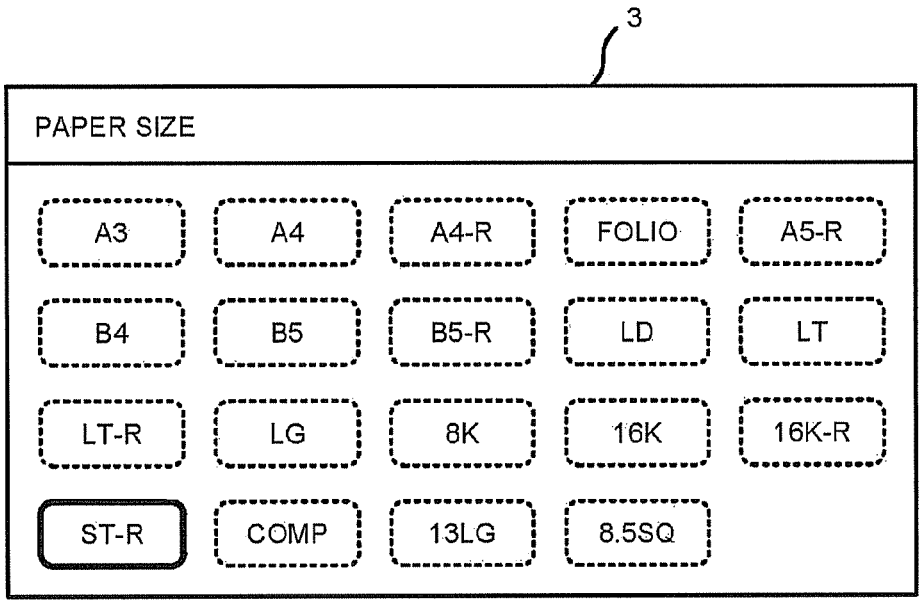
FIG. 5 is a diagram illustrating the setting screen for the sheet size when only one sheet size is detected.

FIG. 5 is a diagram illustrating the setting screen 3 for the sheet size when only one sheet size is detected.

The CPU 11 determines whether or not to accept the call of the setting screen 3 for the sheet size (Act11). The CPU 11 displays a specified setting screen (Act12) when accepting the call of the setting screen 3 (YES in Act11). The CPU 11, for example, displays the setting screen 3 shown in FIG. 5. At this moment, the CPU 11 only displays the button (the ST-R button in FIG. 5) for the detected sheet size, and displays the buttons (the LT-R button, the LG button . . . in FIG. 5) for other detectable sheet sizes in the gray out status.

The CPU 11 forms an image on a sheet by the printing unit according to a print job if accepting an execution instruction of the print job in a status that the sheet size is set through Act1-Act12.

In addition, in the case that the paper feed destination is set to be the paper feed cassette (NO in Act3), the CPU 11 carries out the processing the same as that in Act4-Act12 mentioned above.

The procedure of each processing in the embodiment mentioned above can also differ from exemplified procedure in the embodiment mentioned above.

As described in detail above, according to a technology described herein, a technology for preventing the setting error on the sheet size can be provided.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a stacking section configured to stack a sheet;

a sensor configured to detect only a length in a direction which is orthogonal to a paper feed direction for the sheet which is set on the stacking section;

a printing unit configured to form an image on the sheet;

a display configured to display the image; and a controller configured to display a setting screen for the sheet size and display buttons for multiple detected sheet sizes in a selectable status and display buttons for other detectable sheet sizes together with the buttons for the multiple detected sheet sizes on the setting screen in a non-selectable gray out status when a plurality of the sheet sizes are detected and the controller accepts a call of the setting screen, the controller configured to set the sheet size to be a maximal size when determining the sheet sizes to be multiple and the controller does not accept the call of the setting screen.

2. The image forming apparatus according to claim 1, wherein the sensor detects any one of lengths in a longitudinal direction and a lateral direction of the sheet.

3. The image forming apparatus according to claim 1, wherein the sensor detects any one of the lengths in the longitudinal direction and the lateral direction of the sheet; and the controller sets the sheet size of the image forming object to be only one detected sheet size when only one sheet size is detected.

4. The image forming apparatus according to claim 1, wherein the stacking section is a manual feeding tray which can be directly accessed from external of the image forming apparatus.

5. The image forming apparatus according to claim 1, wherein the stacking section is a paper feed cassette which can be housed inside the image forming apparatus, and can be pulled out from the image forming apparatus.

6. A method for preventing a setting error on a sheet size, which is according to an image forming apparatus comprising a stacking section configured to stack a sheet; a sensor configured to detect the size of the sheet set on the stacking section; a printing unit configured to form an image on the sheet; and a display configured to display the image, including:

detecting only a length in a direction which is orthogonal to a paper feed direction for the sheet on the stacking section based on an output signal from the sensor;

displaying a setting screen for the sheet size;

displaying buttons for multiple detected sheet sizes in a selectable status; and displaying buttons for other detectable sheet sizes together with the buttons for the multiple detected sheet sizes on the setting screen in a non-selectable gray out status when a plurality of the sheet sizes are detected and a controller accepts a call of the setting screen, the controller is configured to set the sheet size to be a maximal size when determining the sheet sizes to be multiple and the controller does not accept the call of the setting screen.

7. The method for preventing the setting error on the sheet size according to claim 6, wherein the sensor detects any one of lengths in a longitudinal direction and a lateral direction of the sheet.

8. The method for preventing the setting error on the sheet size according to claim 6, wherein the sensor detects any one of the lengths in the longitudinal direction and the lateral direction of the sheet;

including:

setting the sheet size of an image forming object to be only one detected sheet size when only one sheet size is detected.

9. The method for preventing the setting error on the sheet size according to claim 6, wherein the size of the sheet on a manual feeding tray which can be directly accessed from external of the image forming apparatus, and serving as the stacking section, is detected based on the output signal from the sensor.

* * * * *